United States Patent [19]

Ueda et al.

[11] Patent Number: 4,822,459

[45] Date of Patent: Apr. 18, 1989

[54] LEAD OXIDE-COATED ELECTRODE FOR USE IN ELECTROLYSIS AND PROCESS FOR PRODUCING THE SAME

[75] Inventors: Minoru Ueda; Akio Watanabe, both of Ibaraki; Takayuki Shimamune, Tokyo, all of Japan

[73] Assignees: Agency of Industrial Science and Technology (MITI), Tokyo; Permelec Lectrode Ltd., Kanagawa, both of Japan

[21] Appl. No.: 91,148

[22] Filed: Aug. 31, 1987

[30] Foreign Application Priority Data

Aug. 29, 1986 [JP] Japan ..... 61-201287
Aug. 29, 1986 [JP] Japan ..... 61-201288

[51] Int. Cl.[4] ..... C25D 5/00

[52] U.S. Cl. ..... 204/38.1; 204/40; 204/56.1; 204/290 F; 427/126.3; 427/126.5; 427/226; 427/327; 427/419.3; 428/421; 428/469; 428/701

[58] Field of Search ..... 204/290 F, 38.1, 56.1, 204/40; 427/126.1, 126.3, 125.5, 226, 372.2, 419.2, 419.3, 327, 299, 190; 428/421, 469, 701

[56] References Cited

U.S. PATENT DOCUMENTS 3,434,942 3/1969 Waterman ..... 204/38.1
4,510,034 4/1985 Ohshima et al. ..... 204/129

OTHER PUBLICATIONS

Chemical Abstracts, vol. 89, No. 22, Nov. 1978, p. 510, Abstract No. 187959x.
Chemical Abstracts, vol. 101, No. 4, Jul. 1984, p. 424, Abstract No. 30198s.

*Primary Examiner*—John F. Niebling
*Assistant Examiner*—Kathryn Gorgos
*Attorney, Agent, or Firm*—Sughrue, Mion, Zinn, Macpeak & Seas

[57] ABSTRACT

A lead oxide-coated electrode for use in electrolysis is disclosed, which comprises a primary layer comprising platinum and/or platinum oxide, an intermediate layer comprising $\alpha$-$PbO_2$, and a coating layer comprising $\beta$-$PbO_2$ successively coated on a substrate comprising a corrosion resistant metal. The electrode has a strong and durable lead oxide coating firmly bonded to the substrate, does not suffer from passivation, resistance increase, etc. and can be used stably for a long time at high current density. A process for producing the electrode is also disclosed.

14 Claims, No Drawings

LEAD OXIDE-COATED ELECTRODE FOR USE IN ELECTROLYSIS AND PROCESS FOR PRODUCING THE SAME

FIELD OF THE INVENTION

This invention relates to a lead oxide-coated electrode for use in electrolysis and, more specifically, it relates to a lead oxide-coated electrode for use in electrolysis suitable as an anode for generating oxygen or ozone, for anodic oxidation, etc. in the electrolysis of an aqueous acidic solution or organic-containing solution, etc. This invention also relates to a process for producing such an electrode.

BACKGROUND OF THE INVENTION

A metal electrode coated with lead oxide has been known to be suitable as an electrode for use in electrolysis requiring corrosion resistance or high oxygen overvoltage, for instance, electrolysis for the generation of oxygen, anodic oxidation, electroplating, electrolysis of organic materials, electrolytic treatment of waste water, etc., and various improvements have been made in the electrode. However, since practical problems have still been present, these electrodes have not yet been used generally for industrial applications.

Lead oxide used as the electrode includes two types, that is, rhombic $\alpha$-$PbO_2$ and tetragonal $\beta$-$PbO_2$ of a rutile type structure. While $\alpha$-$PbO_2$ shows poor corrosion reistance when used as an anode for electrolysis as compared with $\beta$-$PbO_2$, $\alpha$-$PbO_2$ with no substantial internal strain can be obtained by electrodepositions when it is electrolytically formed on a metal substrate such as titanium. On the other hand, while $\beta$-$PbO_2$ has good electroconductivity and good corrosion resistance, if $\beta$-$PbO_2$ is electrolytically formed, internal straining due to electrodeposition is generally increased to cause cracking or deteriorate the bondability with the metal substrate.

In addition, these $PbO_2$ layers are generally poor in mechanical strength, lack processability and passivate the metal substrate, such as titanium, due to the oxidizing effect of $PbO_2$ thereby making electroconduction difficult.

Among the problems as described above, for improving the bondability between the metal substrate and lead oxide, it has been known to adopt a countermeasure for increasing the surface area of the metal substrate, as described, for example, in Japanese Patent Publication Nos. 31396/83 and 34235/84.

Further, there has also been proposed a method of partially depositing a platinum group metal on a metal substrate by electric discharge as described in Japanese Patent Publication No. 45835/82, and a method of disposing fine noble metal portion areas in a distributed manner on the surface of the substrate as described in Japanese Patent Publication No. 32435/79, for preventing the passivation of the metal substrate. According to these methods, however, a large amount of expensive noble metal is needed, which is not practical and, in addition, they involve complicated procedures.

There have also been many proposals relating to coating a lead oxide layer on a metal substrate by way of various primary layers or intermediate layers. For example, there is a method of previously coating a titanium (IV) compound on the surface of a titanium substrate as described in Japanese Patent Publication No. 45191/78, a method of disposing a thin flash layer of a platinum group metal as described in Japanese Patent Publication No. 9236/81, a method of disposing an intermediate layer made of a platinum group metal or metal oxide as described in Japanese Patent Publication Nos. 30957/83, 31396/83, and 34235/84, a method of disposing an intermediate layer of a carbide and boride of a group IV–VI element and/or silicide of a sub-group of group IV - VI elements and/or silicon carbide as described in Japanese Patent Publication No. 72878/75, and a method of disposing a semiconductor intermediate layer made of a tin compound and an antimony compound as described in Japanese Patent Application (OPI) No. 82680/77 (the term "OPI" as used herein refers to "unexamined published patent application).

Among these methods, the method of disposing the intermediate layer containing the platinum group metal or the oxide thereof is not practical since the intermediate layer itself is extremely expensive. In addition, some of these materials are usually employed as an electrode active substance and, since they show a low oxygen overvoltage as an anode as compared with lead oxide, if electrolytes intrude through pin holes, etc. in the lead oxide coating layer, the intermediate layer acts as an anode to evolve gases due to the electrolytic action at the surface of the intermediate layer to possibly result in peeling and destruction of the lead oxide layer. Further, in the method of disposing an intermediate layer not containing a platinum metal group such as an intermediate layer of a semiconductor material of tin and antimony compounds, although there is less possibility that the intermediate layer will act as an anode, the electroconductivity is insufficient leaving a problem for electric current supply. Further, since the radius of lead ions is 0.78 Å for $Pb^{4+}$ (6-coordination), which is greater as compared with 0.69 Å for $Sn^{4+}$ or 0.61 Å for $Ti^{4+}$, it is difficult to firmly bond the intermediate layer and the lead oxide layer to each other by fusion or by forming a solid-solution. Further, since the $\beta$-$PbO_2$ layer has a great ion radius as described above, considerable stresses occur within it, it being the rutile type oxide, and complete bonding is difficult even to the intermediate layer.

In view of the above, use of $\alpha$-$PbO_2$ with less strain has been proposed and alternate layers of $\alpha$-$PbO_2$ and $\beta$-$PbO_2$ are disclosed in Japanese Patent Publication No. 9472/80. It is also known to apply silver plating to the surface of a metal substrate and dispose $\alpha$-$PbO_2$ further thereover as described in Japanese Patent Publication No. 23947/76. While these methods can provide a lead oxide layer with less strain, there have still been problems such as poor corrosion resistance of $\alpha$-$PbO_2$, solution of silver in an acidic solution, etc., and they can not yet be said to be satisfactory.

As has been described above, known lead oxide-coated electrodes involve various problems in view of their performance and manufacture and no practically excellent electrode had been obtained yet.

SUMMARY OF THE INVENTION

An object of the present invention is to provide a lead oxide-coated electrode having a long life time and satisfactory stability, and having $\beta$-$PbO_2$ coatings formed on a metal substrate which is dense and excellent in the bondability and shows less internal strain due to electrodepositions.

This invention firstly provides a lead oxide-coated electrode for use in electrolysis which comprises a primary layer comprising platinum and/or palladium oxide, an intermediate layer comprising $\alpha$-$PbO_2$, and a coating layer comprising $\beta$-$PbO_2$ successively coated on a substrate comprising a corrosion resistant metal.

The present invention also provides a process for producing the above-described lead oxide-coated electrode for use in electrolysis which comprises successively forming on a substrate comprising a corrosion resistant metal, a primary layer comprising platinum and/or palladium oxide, an intermediate layer comprising $\alpha$-$PbO_2$, and a coating layer comprising $\beta$-$PbO_2$.

DETAILED DESCRIPTION OF THE INVENTION

This invention will now be described in more detail.

In the present invention, a corrosion-resistant metal is used as the substrate for the electrode, and titanium, zirconium, niobium and tantalum which are collectively referred to as valve metals or a basic alloy thereof are preferred. The metal substrate has no particular restriction on the shape, and may be a plate, apertured plate, rod-like member, expanded metal, mesh-like member, etc. Further, since a relatively thick layer of lead oxide is subsequently coated on the substrate, it is preferred to apply a roughing treatment to the surface thereby increasing the deposition area. As the roughing treatment, a blasting treatment can be used. The blasting treatment is usually performed using grits or sand having a relatively large particle size. Also, it is desirable to form a fine unevenness on the surface of the substrate by way of pickling using oxalic acid, sulfuric acid, hydrochloric acid, etc. for improving the adherence with the primary layer, as well as to clean or activate the surface.

A primary layer containing platinum and/or palladium oxide is formed on the surface of the thus prepared metal substrate for protecting the substrate and improving the bondability with the intermediate layer. While platinum is usually used in the form of a metal, it is necessary that palladium is used in the form of its oxide since the corrosion resistance of palladium in the form of a metal is poor.

For forming such a primary layer, heat decomposing is usually preferred and a primary coating containing platinum and/or palladium oxide can be obtained with ease by coating a solution containing a heat decomposable salt of platinum and/or palladium, drying and then heating and performing a heat decomposing treatment in air.

The platinum and/or palladium oxides are used for the primary layer in the present invention, because these materials have a sufficiently high oxygen generating over-voltage. Specifically, the lead oxide electrode is often used as an anode in an aqueous solution and the reaction mainly comprises evolution of oxygen. On this case, it has been found that since the lead oxide has a high oxygen generation overvoltage, it is necessary to increase the overvoltage of the primary layer. The above-mentioned materials have been found to sufficiently satisfy this requirement. Electroconductive oxides not using a noble metal, for example, tin oxide or titanium oxide have a sufficiently high overvoltage but have poor electroconductivity, whereas noble metals other than platinum and palladium, such as ruthenium, iridium and rhodium have good electroconductivity but have a lower oxygen overvoltage than that of lead oxide, and thus they are not suitable for use in the present invention.

Although a sufficient effect can be attained by using only platinum and/or palladium oxide in the primary layer, the platinum and/or palladium oxide may be used in admixture with other metal oxides for improving the bondability with the substrate and reducing the amount of expensive noble metal used. As such metal oxides, titanium oxide, tantalum oxide-doped titanium oxide, tin oxide, etc. can be used, by which additional effects can also be expected such as improvement in the corrosion resistance of the primary layer itself and an increase in the oxygen overvoltage. The amount of the other metal oxide in the composition is preferably from 0 to 90 mol% based on the total amount of the primary layer.

A suitable coating thickness of the primary layer is from about 0.05 to 3 $\mu$m. A sufficient coating for the substrate can not be obtained if the thickness of the primary layer is less than 0.05 $\mu$m, whereas electrical resistance tends to be increased if the thickness of the primary layer exceeds 3 $\mu$m.

The heat decomposing conditions for forming the primary layer are properly selected depending on the composition of the coating, and heat treatment may usually be applied in an oxidative atmosphere such as air at a temperature of from 300° to 700° C. for 5 to 30 minutes. The desired coating thickness can be obtained by repeating the coating and heating procedures for the coating solution. For coating the primary layer, coatings of different compositions may be applied in an adequate order thereby obtaining, as a whole, a primary layer of a desired composition, as well as repeating the coating of an identical composition. In the case of applying repeated coatings of different compositions, since the thickness of each coating is thin, ingredients are diffused between layers upon heat treatment of each layer thereby enabling a primary layer coating of sufficiently high electroconductivity as a whole to be obtained.

After forming the primary layer, an intermediate layer comprising $\alpha$-$PbO_2$ is formed. The $\alpha$-$PbO_2$ mainly serves as a joint between the substrate/primary layer and the $\beta$-$PbO_2$ coating layer described later. That is, since the radius of metal ions of $Pb^{4+}$ is greater by 0.1 to 0.2 Å than the radius of metal ions of titanium, tin, tantalum and niobium in the primary layer or the metal substrate and, since all are rutile type oxides and thus have identical crystal configuration, misfitting between the oxides is great and can possibly worsen the bondability. This problem can be moderated by disposing $\alpha$-$PbO_2$ having a different crystal structure as an intermediate layer therebetween. Accordingly, the $\alpha$-$PbO_2$ can be thin so long as it can serve as the joint and, since excessive thickness may possibly cause problems in the corrosion resistance and electroconductivity, the appropriate thickness is from about 20 to 500 $\mu$m. There is no particular restriction for the method of forming the $\mu$-$PbO_2$ intermediate layer, and a method of electrolytically forming the layer from an aqueous alkaline solution containing Pb ions through anodic oxidation is usually suitable. The intermediate layer coating of a desired thickness can be obtained under typical conditions of using an electrolyte in which lead monoxide (PbO) is dissolved to saturation in an aqueous solution of 3 to 5N NaOH and electrolysis is conducted with a current density of from 0.1 to 10 A/dm$^2$, at a temperature of from 20° to 60° C. under a voltage of from 1 to 2 V, for a time from 0.1 to 10 hours using a substrate coated with the primary layer as the anode.

After coating the $\alpha$-$PbO_2$ intermediate layer in this way, a coating layer comprising $\beta$-$PbO_2$ is formed on the surface thereof. The $\beta$-$PbO_2$ layer has an extremely satisfactory affinity with the $\alpha$-$PbO_2$ intermediate layer and known methods of forming $\beta$-$PbO_2$ can be used to make the coating layer. The $\beta$-$PbO_2$ layer can be formed with ease by an electrolytic process using an acidic bath containing lead ions, such as an aqueous 30–35% lead nitrate solution, as the electrolyte and using a substrate coated with the primary layer and the intermediate layer as the anode. Suitably the current density is from 0.1 to 20 A/dm$^2$ and the electrolysis time is from about 0.1 to 10 hours. Although a slight amount of the $\alpha$-$PbO_2$ layer intrudes into the coating layer comprising $\beta$-$PbO_2$ using this method, the intrusion does not result in any problems in view of the durability.

In the electrolytically formed $\beta$-$PbO_2$ layer, internal strains of its own are necessarily produced in view of the crystal structure, and these internal strains can desirably be releaved by incorporating a corrosion resistant and electrochemically inactive granular and/or fibrous material into the $\beta$-$PbO_2$ layer. That is, by incorporating the granular and/or fibrous material into the $\beta$-$PbO_2$ layer, continuous bonding of $\beta$-$PbO_2$ in the coating layer can be avoided to obtain an advantageous effect of dispersing the internal strains formed in the $\beta$-$PbO_2$ layer due to electrodeposition.

As the corrosion resistant and electrochemically inactive material to be incorporated and dispersed in the $\beta$-$PbO_2$ coating layer, any material can be used so long as the material is corrosion resistant and exerts no effect on the electrochemical activity of the $\beta$-$PbO_2$ layer. Metal oxides are generally suitable since they are corrosion resistant and less reactive, and oxides of metals of group IV and group V of the periodic table such as Ti, Ta, Zr, Hf, Nb and V are particularly effective. Carbides, nitrides or borides of these metals can also be used. Further, fluoro resins can also be used suitably since they are excellent in chemical resistance and show no reactivity. Those metals referred to as valve metals exemplified above among the group IV and group V elements can also be used in the form of a metal since they produce passivated corrosion resistant oxide films at the surface by the anodic oxidation and show no reactivity.

The content of these materials can properly be selected, and, suitably, it is from about 0.01 to 10% by weight based on the total amount of the coating layer. The granule or fiber diameter of these materials is preferably less than 500 $\mu$m.

There is no particular restriction for the method of forming such a coating layer and it is suitable to employ an electrolytic forming method combined with a so-called dispersed plating method in which a $\beta$-$PbO_2$ layer is electrolytically formed while dispersing the granular and/or fibrous material in the electrolyte. Further, formation of the $\beta$-$PbO_2$ layer and the introduction of the above-mentioned material can be conducted separately in an appropriate order. That is, a coating layer comprising a $\beta$-$PbO_2$ layer and a layer of the fibrous and/or granular material alternately may be formed by repeating, for several times, the procedures of forming a thin $\beta$-$PbO_2$ layer electrolytically, coating the fibrous and/or granular material thereover and then baking. Conventional methods can be used for the electrolytic conditions and, usually, electrolysis may be conducted in a lead nitrate bath while using the intermediate-coated substrate as the anode, preferably, with the current density from 0.1 to 10 A/dm$^2$ and at a temperature of from about 40° to 80° C.

In this way, a lead oxide-coated electrode having a $\beta$-$PbO_2$ layer as the electrode active surface can be obtained with ease.

This invention will now be described referring to examples but the invention is in no way limited only thereto. Unless otherwise specified, all percents, ratios, etc. are by weight.

EXAMPLE 1 AND COMPARATIVE EXAMPLES 1 TO 3

The surface of an expanded mesh made of pure titanium of 1.5 mm plate thickness was blasted by using #70 stainless steel grits (average grain size: 0.7 mm) and washed for 15 min. in a boiling aqueous 25% hydrochloric acid solution. Then, using the titanium expanded mesh as the substrate, a primary layer comprising platinum and tantalum oxide in Pt/Ta=1/1 (metal molar ratio) composition was disposed on the surface thereof to a thickness of 0.1 $\mu$m. The primary layer was formed by using platinum in the form of chloroplatinic acid and tantalum in the form of tantalum pentachloride dissolved in an aqueous 4% hydrochloric acid solution used as the coating solution for the primary layer. and repeating 4 times the procedures of coating the solution by brushing onto the expanded mesh of the substrate, drying at 40° C. and then heating in a muffle furnace at 500° C. for 10 minutes.

Then, electrolysis was conducted using the thus formed primary layer as the anode and a titanium plate as the cathode, in an electrolyte comprising lead monoxide (PbO) dissolved to saturation in an aqueous 3.5N sodium hydroxide solution at 40° C., with a current density of 1 A/dm$^2$ for two hours thereby forming an $\alpha$-$PbO_2$ coating layer as the intermediate layer. The thickness of the intermediate layer was about 100 $\mu$m.

Further, a lead dioxide layer composed of $\mu$-$PbO_2$ was formed as the surface coating layer by the electrolytic method as described below. That is, electric current was supplied using an aqueous 30% lead nitrate solution as an electrolyte and using a titanium plate as a cathode while stirring the solution with a magnetic stirrer, at a temperature of from 65° to 70° C. with a current density of 2 A/dm$^2$ for 2 hours. Thus, an electrode having a $\beta$-$PbO_2$ coating layer of about 200 $\mu$m thickness was obtained.

As comparative Examples, specimens were prepared in the same manner as described above except for deleting the platinum - tantalum oxide primary layer (Comparative Example 1), deleting the $\alpha$-$PbO_2$ intermediate layer (Comparative Example 2) and using only the surface coating $\beta$-$PbO_2$ layer (Comparative Example 3).

An accelerated electrolysis test was conducted on the specimens using them as the anode in an aqueous 150 g/l sulfuric acid solution at 60° C. with a current density of 200 A/cm$^2$.

The results are shown in Table 1.

TABLE 1

| | Electrode Coatings | | | |
|---|---|---|---|---|
| No. | Primary Layer | Intermediate Layer | Coating Layer | Life time (hr) |
| Example 1 | Pt—Ta oxide | $\alpha$-$PbO_2$ | $\beta$-$PbO_2$ | more than 300 |
| Comparative Example 1 | — | $\alpha$-$PbO_2$ | $\beta$-$PbO_2$ | 5 |
| Comparative | Pt—Ta oxide | — | $\beta$-$PbO_2$ | 67 |

TABLE 1-continued

| No. | Electrode Coatings | | | Life time (hr) |
|---|---|---|---|---|
| | Primary Layer | Intermediate Layer | Coating Layer | |
| Example 2 | | | | |
| Comparative Example 3 | — | — | $\beta$-$PbO_2$ | 3 |

As can be seen from the Table 1, for the specimens with no primary layer (Comparative Examples 1 and 3), current conduction became impossible within 3 to 5 hours from the beginning and the coating peeled from the substrate. In the specimen in which no intermediate layer was disposed but the surface coating layer was disposed directly above the primary layer (Comparative Example 2), although a certain life time was recognized, the coating layer peeled early during electrolysis since the bondability was poor between the $\beta$-$PbO_2$ (coating layer) and the primary layer. On the other hand, the electrode according to the present invention (Example 1) showed neither weight reduction nor peeling during electrolysis for more than 300 hours and electrolysis could be conducted stably for a long period of time.

EXAMPLE 2

A titanium substrate was prepared in the same manner as in Example 1. A coating composed of tantalum oxide and titanium oxide (metal molar ratio 1/2) was first formed on the surface to a thickness of about 0.1 $\mu$m and then a coating composed of platinum and an oxide mixture of tantalum oxide and titanium oxide (metal molar ratio: 3/1/2) was formed to a thickness of about 0.1 $\mu$m to form a primary layer. The primary layer was formed by coating an aqueous hydrochloric acid solution of tantalum pentachloride and titanium tetrachloride, and an aqueous hydrochloric acid solution of chloroplatinic acid, tantalum pentachloride and titanium tetrachloride on the substrate, respectively, drying and then heating at 550° C. in air. The procedures of coating and heating were repeated twice for each of the coatings. Next an $\alpha$-$PbO_2$ layer was disposed in the same manner as in Example 1 over the primary layer. The electrolysis was conducted for one hour to form the $\alpha$-$PbO_2$ layer to a thickness of about 100 $\mu$m.

Then, a coating layer composed of $\beta$-$PbO_2$ was electrolytically formed over the $\alpha$-$PbO_2$ layer. Electrolysis was conducted using an aqueous 35% lead nitrate solution as an electrolyte under stirring by passing nitrogen gas through the solution with a current density of 2 A/dm$^2$ for 2 hours to obtain a coating layer of about 500 $\mu$m thickness. The electrolysis temperature was 50° C.

When conducting an accelerated electrolysis test in the same manner as in Example 1 for the specimen electrode, it was found that there was no change in voltage increase, etc. even for continuous electrolysis for more than 100 hours and it could be used with extreme stability.

EXAMPLE 3

A titanium substrate was prepared in the same manner as in Example 1. A primary layer composed of palladium oxide and tin oxide was formed on the surface. The primary layer was formed by using a coating solution prepared by dissolving palladium chloride in an n-amyl alcohol solution on n-amyl alkoxy tin, coating the solution on the substrate by brushing, drying at 150° C. and then baking at 500° C. The procedures were repeated twice to form a primary coating of 0.2 $\mu$m thickness. Further, the product was placed in a muffle furnace at 600° C. and sintered to stabilize for 2 hours. Then, an $\alpha$-$PbO_2$ layer of about 200 $\mu$m thickness was formed in the same manner as in Example 1.

A lead oxide layer composed of $\beta$-$PbO_2$ was electrolytically formed as the coating layer on the $\beta$-$PbO_2$ layer. The electrolysis was conducted under the same conditions as in Example 2 for 4 hours to obtain a $\beta$-$PbO_2$ coating layer of about 1 mm thickness.

An accelerated electrolysis test was conducted for the specimen in the same manner as in Example 1 in an aqueous 150 g/l $H_2SO_4$ solution at 60° C. As a result, after conducting electrolysis with an electric current density of 100 A/dm$^2$ for more than 400 hours, there was neither substantial weight change nor cracking in the coating layer. Only discoloration observed at the surface.

EXAMPLE 4 AND COMPARATIVE EXAMPLES 4–6

The surface of an expanded mesh made of pure titanium of 1.5 mm plate thickness was blasted by using #70 stainless steel grits (average grain size: 0.7 mm) and washed for 15 min. in a boiling aqueous 25% hydrochloric acid solution. Then, using the titanium expanded mesh as the substrate, a primary layer comprising platinum and tantalum oxide in Pt/Ta=1/1 (metal molar ratio) composition was disposed on the surface thereof to a thickness of 0.1 $\mu$m. The primary layer was formed by using platinum in the form of chloroplatinic acid and tantalum in the form of tantalum pentachloride dissolved in an aqueous 4% hydrochloric acid solution used as the coating solution for the primary layer, and repeating 4 times the procedures of coating the solution by brushing on the expanded mesh of the substrate, drying at 40° C. and then heating in a muffle furnace at 570° C. for 10 minutes.

Then, electrolysis was conducted using the thus formed primary layer as the anode and a titanium plate as the cathode, in an electrolyte comprising lead monoxide (PbO) dissolved to saturation in an aqueous 3.5N sodium hydroxide solution at 40° C., with a current density of 1 A/dm$^2$ for two hours thereby forming an $\alpha$-$PbO_2$ coating layer as the intermediate layer. The thickness of the intermediate layer was about 100 $\mu$m.

Further, a lead dioxide layer composed of $\beta$-$PbO_2$ containing a fluoro resin was formed as the surface coating layer under the conditions described below. An electrolyte was prepared by adding 10 ml of a fluoro resin dispersion (trade name, "Teflon 30J" manufactured by Mitsui Du Pont Fluoro Chemical) per 1 liter of an aqueous 30% solution of lead nitrate. Electric current was supplied while using a titanium plate as a cathode under stirring the solution by passing nitrogen gas therethrough at a temperature of from 65° to 70° C. with a current density of 2 A/dm$^2$ for 2 hours. Thus, a lead oxide layer containing fluoro resin of about 300 $\mu$m thickness was obtained.

As comparative electrodes, specimens were prepared in the same manner as above except for deleting the platinum-tantalum oxide primary layer (Comparative Example 4), deleting the $\alpha$-$PbO_2$ intermediate layer (Comparative Example 5) and using only the surface coating layer (Comparative Example 6).

An accelerated electrolysis test was conducted on the specimens using them as the anode in an aqueous 150 g/l sulfuric acid solution at 60° C. with a current density of 100 A/cm$^2$.

The results are shown in Table 2.

TABLE 2

| No. | Electrode Coatings: Primary Layer | Intermediate Layer | Coating Layer | Life time (hr) |
|---|---|---|---|---|
| Example 4 | Pt—Ta oxide | $\alpha$-$PbO_2$ | Fluoro resin-containing $\beta$-$PbO_2$ | more than 500 |
| Comparative Example 4 | — | $\alpha$-$PbO_2$ | Fluoro resin-containing $\beta$-$PbO_2$ | 64 |
| Comparative Example 5 | Pt—Ta oxide | — | Fluoro resin-containing $\beta$-$PbO_2$ | 145 |
| Comparative Example 6 | — | — | Fluoro resin-containing $\beta$-$PbO_2$ | 30 |

As can be seen from Table 2, for the specimens with no primary layer (Comparative Examples 4 and 6), current condition became impossible within a short period of time and the coating peeled from the substrate.

In the specimen in which no intermediate layer was disposed but the surface coating layer was disposed directly above the primary layer (Comparative Example 5), although a certain life time was recognized, cracking was formed soon during electrolysis. On the other hand, the electrode according to the present invention (Example 4) showed neither weight reduction nor peeling during electrolysis for more than 500 hours and electrolysis could be conducted stably for a long period of time.

EXAMPLE 5

A titanium substrate was prepared in the same manner as in Example 4. A coating composed on tantalum oxide was at first formed on the surface to a thickness of about 0.1 μm and then a coating composed of an oxide mixture of palladium oxide and tantalum oxide was formed to a thickness of about 0.1 μm to form a primary layer. The primary layer was formed by coating an aqueous hydrochloric acid solution of tantalum pentachloride and an aqueous hydrochloric acid solution of palladium chloride and tantalum pentachloride on the substrate, respectively, drying and then heating them 550° C. for 10 min. in air. The procedures of coating and heating were repeated three times for each of the coatings. An $\alpha$-$PbO_2$ layer was disposed in the same manner as in Example 4 over the primary layer. The electrolysis was conducted for one hour to form the $\alpha$-$PbO_2$ layer to a thickness of about 100 μm.

Then, a coating layer composed of $\beta$-$PbO_2$ containing niobium oxide dispersed therein was electrolytically formed on the $\alpha$-$PbO_2$ layer. An aqueous 35% lead nitrate solution containing 10 g of fine niobium oxide fully passing 345 mesh dispersed per 1 liter of the solution was used as an electrolyte. Electrolysis was conducted using the electrolyte under stirring by using a magnetic stirrer with a current density of 4 A/dm$^2$ for 2 hours to obtain a coating layer of about 1 mm thickness. The electrolysis temperature was 40° C.

When conducting an accelerated electrolysis test in the same manner as in Example 4 for the specimen in 150 g/l sulfuric acid, it was found that there was neither a voltage increase, nor peeling of the coating layer at all even for electrolysis for more than 500 hours with a current density of 100 A/dm$^2$.

EXAMPLE 6

A titanium substrate was prepared in the same manner as in Example 4. A primary layer composed of platinum and tin oxide was formed on the surface. The primary layer was formed by using a coating solution prepared by dissolving chloroplatinic acid in n-amyl alcohol solution of n-amyl alkoxy tin, coating the solution on the substrate by brushing, drying at 150° C. and then baking at 500° C. The procedures were repeated twice to form a primary coating of 0.2 μm thickness. Then, an $\alpha$-$PbO_2$ layer of about 200 μm thickness was formed in the same manner as in Example 4.

A lead oxide layer composed of $\beta$-$PbO_2$ containing titanium dispersed therein was electrolytically formed as the coating layer on the $\alpha$-$PbO_2$ layer. Titanium sponge pulverized in ethanol into products fully passing 275 mesh was used as titanium. The electrolysis was conducted under the same conditions as in Example 5 for 4 hours to obtain lead oxide-coated electrode having a $\beta$-$PbO_2$ coating layer of about 2 mm thickness.

An accelerated electrolysis test was conducted for the specimen in the same manner as in Example 4 using an aqueous 150 g/l $H_2SO_4$ solution. As a result, after conducting electrolysis for 700 hours, there was neither substantial weight change nor cracking in the coating layer. Only discoloration was observed at the surface.

In the present invention, since corrosion resistant metal is used for the electrode substrate and a primary layer comprising platinum and/or palladium oxide, an intermediate layer comprising $\alpha$-$PbO_2$ and a coating layer comprising $\beta$-$PbO_2$ are successively coated thereover, the layers are firmly adhered to the substrate thereby enabling the obtainment of a lead oxide-coated electrode with no strains due to electrodeposition, being strong and having high durability. In addition, passivation and the resistance increase of the electrode can be prevented, and the electrode according to the present invention can be used stably for a long period of time even during electrolysis at high current density, which is extremely useful as an electrode for various electrolysis or electrolytic treatments requiring high corrosion resistance and high oxygen overvoltage.

While the invention has been described in detail and with reference to specific embodiments thereof, it will be apparent to one skilled in the art that various changes and modifications can be made therein without departing from the spirit and scope thereof.

What is claimed is:

1. A lead oxide-coated electrode for use in electrolysis which comprises (1) a primary layer comprising platinum, palladium oxide, or mixtures thereof, (2) an intermediate layer comprising $\alpha$-$PbO_2$, and (3) a coating layer comprising $\beta$-$PbO_2$ and having dispersed therein a corrosion resistant and electrochemically inactive granular material, fibrous material or mixtures thereof, each of (1), (2) and (3) successively coated on a substrate comprising a corrosion resistant metal.

2. An electrode as claimed in claim 1, wherein the corrosion resistant metal of the substrate is titanium, zirconium, niobium, tantalum or a base alloy thereof.

3. An electrode as claimed in claim 1, wherein the primary layer (1) comprises platinum, palladium oxide or mixtures thereof and at least one of oxides of titanium, tantalum or tin.

4. An electrode as claimed in claim 1, wherein the thickness of the intermediate layer (2) is from 20 to 500 μm.

5. An electrode as claimed in claim 1, wherein the granular material, fibrous material or mixtures thereof is a metal selected from group IV and group V elements of the periodic table or oxides, carbides, nitrides or borides of said metals.

6. An electrode as claimed in claim 1, wherein the granular material, fibrous material or mixtures thereof comprises a fluoro resin.

7. A process for producing a lead oxide-coated electrode for use in electrolysis, which comprises successively forming, on a substrate comprising a corrosion resistant metal, (1) a primary layer comprising platinum, palladium oxide, or mixtures thereof, (2) an intermediate layer comprising $\alpha$-$PbO_2$, and (3) a coating layer comprising $\beta$-$PbO_2$ electrolytically formed from an acidic bath containing lead ions and having dispersed therein a corrosion resistant and electrochemically inactive granular material, fibrous material or mixtures thereof.

8. A process as claimed in claim 7, wherein the surface of the corrosion resistant metal substrate is subjected to blasting, pickling or a combination of blasting and pickling prior to forming the primary layer.

9. A process as claimed in claim 7, wherein the primary layer (1) is formed by coating a solution containing a heat decomposable salt of platinum, palladium or mixtures thereof on the substrate and then subjecting the coated solution to heat treatment.

10. A process as claimed in claim 7, wherein the intermediate layer (2) is electrolytically formed from an alkaline bath containing lead ions.

11. A process for producing a lead oxide-coated electrode for use in electrolysis, which comprises successively forming, on a substrate comprising a corrosion resistant metal, (1) a primary layer comprising platinum, palladium oxide or mixtures thereof, (2) an intermediate layer comprising $\alpha$-$PbO_2$, and (3) a coating layer comprising $\beta$-$PbO_2$, electrically formed from an acidic bath containing lead ions having dispersed therein a corrosion resistant and electrochemically inactive granular material, fibrous material or mixtures thereof and wherein the coated layer (3) is formed by repeating the step of forming said $\beta$-$PbO_2$ layer with said corrosion resistant and electrochemically inactive granular, fibrous material or mixtures thereof.

12. A process as claimed in claim 11, wherein the surface of the corrosion resistant metal substrate is subjected to blasting, pickling or a combination of blasting and pickling prior to forming the primary layer (1).

13. A process as claimed in claim 12, wherein the primary layer (1) is formed by coating a solution containing a heat decomposable salt of platinum, palladium or mixtures thereof on the substrate and then subjecting the coated solution to heat treatment.

14. A process as claimed in claim 11, wherein the intermediate layer (2) is electrolytically formed from an alkaline bath containing lead ions.

* * * * *